United States Patent [19]

Fischer

[11] 4,109,409

[45] Aug. 29, 1978

[54] STRUCTURAL ELEMENT FOR CONSTRUCTION KITS AND METHOD OF MAKING THE ELEMENT

[76] Inventor: Artur Fischer, Weinhalde 34, D-7244 Waldachtal 3 (Tumlingen), Fed. Rep. of Germany

[21] Appl. No.: 802,565

[22] Filed: Jun. 1, 1977

[30] Foreign Application Priority Data

Jun. 16, 1976 [DE] Fed. Rep. of Germany ..... 2626983

[51] Int. Cl.[2] ..... A63H 33/08

[52] U.S. Cl. ..... 46/25; 46/27

[58] Field of Search ..... 46/25, 26, 27, 28, 24, 46/23, 16, 17; 35/72

[56] References Cited

U.S. PATENT DOCUMENTS

| | | | |
|---|---|---|---|
| 1,245,440 | 11/1917 | Converse | 46/25 |
| 2,619,829 | 12/1952 | Tatum | 46/25 X |

FOREIGN PATENT DOCUMENTS

| | | | |
|---|---|---|---|
| 209,232 | 1960 | Fed. Rep. of Germany | 46/16 |
| 385,086 | 1965 | Switzerland | 46/25 |
| 506,204 | 1939 | United Kingdom | 46/26 |
| 845,986 | 1960 | United Kingdom | 46/25 |

*Primary Examiner*—Louis G. Mancene
*Assistant Examiner*—Mickey Yu
*Attorney, Agent, or Firm*—Michael J. Striker

[57] ABSTRACT

A structural element, particularly for multi-element toy kits, includes an elongated circumferential wall which bounds an interior space and which has opposite ends. An end wall overlies one of the ends of the circumferential wall. The interior space is subdivided by two partitions. Each partition has side portions connectable with the circumferential wall, and an undercut coupling projection which projects from the respective partition. An elongated groove is formed at the end wall and has an open end at the circumferential wall. The groove is undercut complementarily to the projection for slidably receiving an undercut coupling projection of another structural element through the open end of the groove. The structural element may be made by injection molding.

12 Claims, 2 Drawing Figures

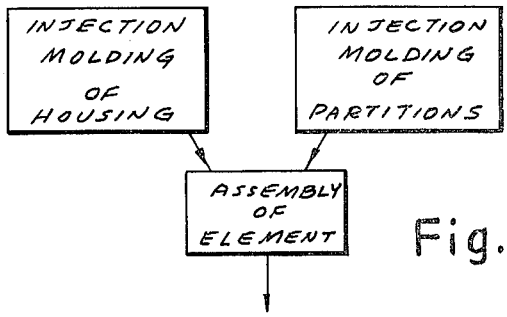
Fig. 3
Fig. 1
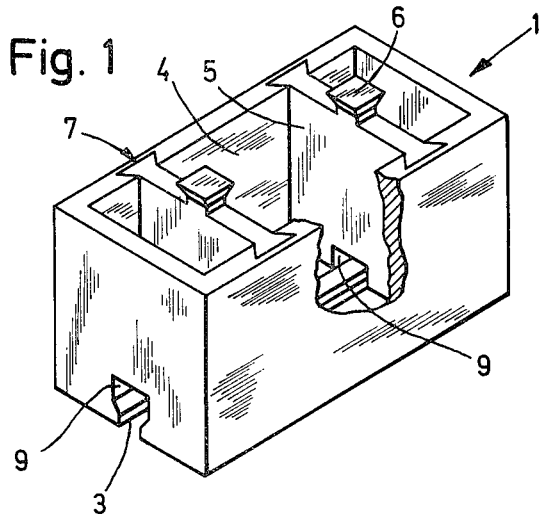
Fig. 2
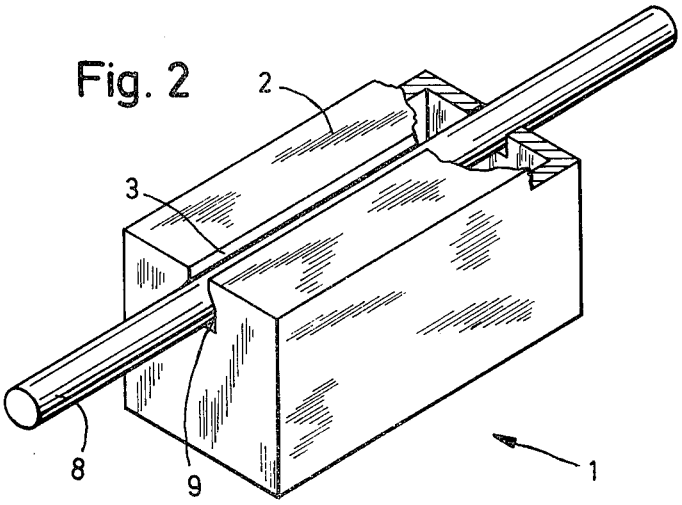

STRUCTURAL ELEMENT FOR CONSTRUCTION KITS AND METHOD OF MAKING THE ELEMENT

BACKGROUND OF THE INVENTION

The present invention generally relates to a structural element and, more particularly, to a structural element which is connectable with other structural elements in multi-element toy construction kits. Still more particularly, the invention relates to a method of making such a structural element.

In the art of toy construction kits, it has been proposed to form individual parallelepiped-shaped hollow building blocks with an open side. The proposed blocks have connecting portions which are located at the side opposite to this open side. These connecting portions are clampable by snap-mounting into the open side of another building block.

However, the stability of this snap-assembly depends upon the manufacturing tolerances of both the connecting portions of one block and the dimension of the opening at the open side of another block. Therefore, such manufacturing tolerances must be strictly controlled. If such strict control is not enforced, then the blocks may either become too-tightly wedged together, thereby making it difficult for a child to dettach the two blocks, or the blocks may become too loosely held together, thereby leading to an unstable assembly.

In order for such known building blocks to resist turning or sliding movement relative to each other, additional abutments are required to be positioned in the interior of the hollow building block. This represents an additional expense in the cost of manufacture.

SUMMARY OF THE INVENTION

Accordingly, it is the general object of the present invention to provide multi-element toy construction kits having individual structural elements which are slidably assemblable with each other.

Another object of the present invention is to provide a stable assembly of structural elements which is resistant to turning and/or pulling forces acting in direction transverse to the direction of sliding movement.

Yet another object of the present invention is to provide a structural element with exposed side walls which are free of connecting portions.

An additional object of the present invention is to provide a reliable and inexpensive structural element for use with other structural elements in multi-element construction kits.

In keeping with these objects and others which will become apparent hereinafter, one feature of the invention resides in a structural element, particularly for assembly with other structural elements in multi-element construction kits, comprising wall means bounding an interior space, including an elongated circumferential wall having opposite ends, and an end wall overlying one of said ends of said circumferential wall. The interior space is subdivided by at least one and preferably two partitions. Each partition has side portions connectable with the circumferential wall, and an end portion at the other of said ends of the circumferential wall. An undercut coupling projection projects from the end portion of each partition in direction away from the end wall. An elongated groove is provided at the end wall and has an open end at the circumferential wall. The groove has an undercut portion complementarily to the projection for slidably receiving an undercut coupling projection of another structural element through the open end of the groove.

The sliding connection of a projection of one structural element with a groove of another structural element results in a highly stable and reliable assembly in which each structural element is resistant to turning and/or pulling forces acting in direction transverse to the direction of sliding movement relative to another structural element. The circumferential wall comprises a plurality of side walls all of which are free of connecting portions, thereby making the construction kit particularly useful for building walls and for building car bodies.

In accordance with another feature of the invention, it is desirable if the partitions are arranged in the interior of the structural element so that the projections always lie at the corners of an imaginary grid which has two intersecting sets of parallel lines. It is thereby guaranteed that a larger-dimensioned structural element can be interchanged with a plurality of smaller-sized structural elements.

In accordance with yet another feature of the invention, the structural element itself may be made by an injection-type process. In one injection-type molding operation, a block-type housing having a circumferential wall which bounds an interior space is formed with undercut portions, and an end wall which overlies an end of the circumferential wall and which is likewise formed with an undercut groove. In another injection-type molding operation, a pair of partitions having side portions of undercut configuration complementarily to the undercut portions of the circumferential wall are formed. In addition, a coupling projection portion projecting from each of the partitions is formed at the other end of the circumferential wall, and the projection portion is undercut complementarily to the undercut groove. The side portions of the partitions are then slidably inserted into the undercut portions of the circumferential wall in order to form a structural element having the undercut groove at one of its ends and the undercut projection portion at the other of its ends.

Although it is possible to form the structural element of one-piece in a single operation, the work tool required is rather complicated and expensive. Further, it is required to slit the projection portions in order to make them more resilient. Therefore, by making the partitions separately from the making of the block-type housing, the invention obtains a simpler and more advantageous method of making the structural element, as well as requiring a simple work tool which does not require a great deal of maintenance.

The projection portions are preferably of one-piece with their respective partition. However, it is likewise possible to injection-mold each projection separately and thereafter to assemble the projection onto the partition.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIG. 1 is a partially broken-away perspective view of a structural element in accordance with the present invention;

FIG. 2 is a partially broken-away perspective view of the structural element of FIG. 1 as viewed from the underside and showing the manner of interconnection with another structural element; and FIG. 3 is a diagrammatic flow diagram showing a method of making the structural element of FIG. 1.

DESCRIPTION OF THE PREFERRED EMBODIMENT

FIG. 1 shows a structural element or building block 1. As will be shown herein, the block 1 has undercut projections and grooves which detachably connect with similar undercut grooves and projections of other building blocks. All of these building blocks together with other structural elements of different configuration comprise a multi-element construction kit, particularly but not necessarily a toy kit.

Each block 1 includes wall means 10 bounding an interior space 4. The wall means 10 includes a circumferential wall which is elongated in vertical direction and which has an upper open end and a lower closed end. The terms "upper" and "lower" are descriptive only, and the use of such designations is intended merely to simplify the description of the illustrated block 1 without in any way limiting the invention should the block 1 be inverted from its illustrated position.

Wall means 10 includes a first pair of generally rectangular side walls and a second pair of generally square side walls, each side wall extending intermediate the upper open end and the lower closed end. An end wall 2 (see FIG. 2) overlies and closes the lower closed end, thereby forming a hollow parallelepiped-shaped block having an open side.

The interior space 4 is subdivided by at least one and preferably two partitions 5 which are located in the interior of the block 1. Each partition 5 has undercut male coupling type or stud portions 7 at its opposite sides which are slidably insertable into complementary undercut female coupling type or recesses 7 formed in the inner faces of the rectangular side walls. Of course, the stud portions could be provided on the rectangular side walls and the undercut recesses could be formed at the side portions of each partition.

At the upper end portion 12 of each partition, an undercut coupling projection 6 projects upwardly in direction away from the end wall 2. The projection 6 has a planar free end face and a generally rectangular-shaped cross-section. Each projection 6 has a neck portion of constant rectangular cross-section and an outwardly flaring portion which increases in cross-section in direction towards the free end face.

An elongated groove 3 is formed at the end wall 2 and has an open end at each square-shaped side wall. Groove 3 is undercut complementarily to a projection 6 and is operative for slidably receiving an undercut coupling projection of another structural element through the open end of the groove 3. Groove 3 extends lengthwise intermediate the square shaped side walls.

Groove 3 also has a generally rectangular-shaped cutout portion 9 which extends from the undercut portion of the groove 3 in direction away from the end wall 2. Similar rectangularly-shaped cutout portions or notches 9′ are formed in the partitions 5.

For assembly, a first building block is placed on a support, for example in the orientation shown in FIG. 1. A second building block is positioned over the first block so that the groove 3 of the second block slidably receives a projection 6, for example the projection 6 at the left side of FIG. 1. A third building block may be positioned over the first block so that the groove 3 of the third block slidably receives the projection 6 at the right side of FIG. 1. A wall of building blocks is formed in mutual overlapping relationship by continuing this procedure.

Of course the second and/or the third blocks need not be aligned so that their rectangular side walls are arranged in the same plane with the rectangular side wall of the first block. The second and/or third block may be oriented so that their square side wall lies in the plane of the rectangular side wall of the first block.

In this manner blocks can be assembled in direction normally of the first block.

It is preferable if the partitions 5 are arranged in the interior space 4 so that the projections 6 always lie at the corners of an imaginary grid which has two intersecting sets of parallel lines. That is, no matter which way the blocks are assembled relative to each other the projections 6 will always be located on these sets of lines.

This may be obtained by carefully dimensioning the block. If the block has a predetermined distance or length intermediate its square-shaped side walls, then the rectangular side walls are spaced apart by a distance equal to one-half of the length dimension. Moreover, each projection 6 is located midway between the rectangular side walls, that is, each projection 6 is spaced from a respective rectangular side wall by a distance equal to one-fourth of this length dimension. In addition, each projection 6 is spaced from a respective square-shaped side wall by a distance equal to one-fourth of this length dimension, and the two projections are spaced relative to each other by a distance equal to one-half of this length dimension.

In order to interconnect two blocks in direction lengthwise of each other, i.e. with their respective square-shaped side walls facing each other, a rod-shaped element or tubular pin 8 is utilized. Cutout portion 9 of groove 3 and notches 9′ slidably receive the pin 8. The cross-section of cutout 9 and notches 9′ either friction-tightly receive the pin 8 or receive the same with slight clearance. In order to interconnect two blocks, the respective groove 3 of each block receives different portions of the pin 8.

Other configurations for the building block are likewise contemplated. The block 1 may have a cubic configuration, a triangular configuration, a semi-circular configuration and the like. Preferably, the building block is made of synthetic plastic material which is formed by injection molding.

FIG. 3 shows a flow diagram of the method of making the structural element 1. The block-type housing may initially be injection molded, and thereupon the partitions 5 may be likewise injection molded. Subsequently, the partitions are slidably inserted so that the stud portions 11 are friction-tightly received with resilient engagement in the undercut recesses 7. Each structural element thus formed has an undercut groove 3 at one end and undercut projections 6 at its other end. The pin 8 may likewise be formed by injection molding.

It will be understood that each of the elements described above, or two or more together, may also find a useful application in other types of constructions differing from the types described above.

While the invention has been illustrated and described as embodied in a structural element for construction kits and method of making the element, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omittting features that from the standpoint of prior art, fairly constitute essential characteristics of the generic or specific aspects of this invention.

What is claimed as new and desired to be protected by Letters Patent is set forth in the appended claims:

1. A hollow structural element, particularly for assembly with other structural elements in multielement construction kits, comprising means including an elongated complete circumferential wall bounding an interior space having opposite ends and two pairs of opposite side walls, and an end wall closing one of said ends of said interior space, whereas another of said ends thereof remains open; means for subdividing said interior space, including at least one partition having side portions connectable with said circumferential wall, and an end portion at said open end of said interior space, an undercut coupling projection projecting from said end portion of said one partition at said open end of said interior space in direction away from said end wall outwardly beyond said interior space and engageable in an undercut coupling indentation of another structural element so that in an engaged condition said other structural element bridges said open end of said first-mentioned structural element; and an elongated groove at said end wall and thereby at said closed end of said interior space, said groove extending along the the entire length of said end wall from one to another of one pair of said opposite side walls and having ends which are open thereat, said groove having an undercut portion complementary to said projection for slidably receiving an undercut coupling projection of a further structural element through either of said open ends of said groove.

2. A structural element as defined in claim 1, wherein each side portion of said one partition has an undercut configuration; and wherein said circumferential wall includes a pair of side walls spaced from each other, each side wall having a cooperating portion which is undercut complementarily to a respective undercut side portion of said one partition.

3. A structural element as defined in claim 2, wherein each side portion of said one partition has an undercut coupling stud, and wherein each side wall of said pair has an elongated undercut coupling recess which has an open end at said other end, each recess being operative for slidably receiving the respective undercut stud through said open end of the respective recess.

4. In a multi-element construction kit, a plurality of hollow connectable structural elements, each of said structural elements comprising means including an elongated complete circumferential wall bounding an interior space having opposite ends and two pairs of opposite side walls, and an end wall closing one of said ends of said interior space, whereas another of said ends thereof remains open; means for subdividing said interior space, including at least one partition having side portions connectable with said circumferential wall, and an end portion at said open end of said interior space, an undercut coupling projection projecting from said end portion of said one partition at said open end of said interior space in direction away from said end wall and engageable in an undercut coupling indentation of another structural element so that in an engaged condition said other structural element bridges said open end of said first-mentioned structural element; and an elongated groove at said end wall and thereby at said closed end of said interior space, said groove extending along the entire length of said end wall from one to another of one pair of said opposite side walls and having ends which are open thereat, said groove having an undercut portion complementary to said projection for slidably receiving an undercut coupling projection of a further structural element through either of said open ends of said groove.

5. A structural element as defined in claim 4, wherein said coupling projection is located substantially midway between said side portions of said one partition.

6. A structural element as defined in claim 4, wherein said coupling projection has a polygonally-shaped cross-section.

7. A structural element as defined in claim 4, wherein said circumferential wall includes a first pair of side walls spaced from each other by a predetermined distance, and a second pair of side walls spaced from each other by a distance equal substantially to one half of said predetermined distance; and wherein said subdividing means includes another partition having an undercut coupling projection; and wherein each projection is spaced relative to a respective side wall of said first pair at a distance substantially equal to one-fourth of said predetermined distance, and wherein each projection is spaced relative to a respective side wall of said second pair at a distance substantially equal to one-fourth of said predetermined distance, and wherein said projections are spaced relative to each other by a distance substantially equal to one-half of said predetermined distance.

8. A structural element as defined in claim 4, wherein said groove has a cutout portion extending from said undercut portion in direction away from said end wall.

9. A structural element as defined in claim 8, wherein said cutout portion has a substantially rectangular configuration.

10. A structural element as defined in claim 4, wherein said subdividing means includes another partition spaced from said one partition, and wherein each partition has a notch of substantially rectangular configuration.

11. In a kit as defined in claim 4; and further comprising means for interconnecting said structural elements, including a rod-shaped element receivable in respective grooves of two adjacent structural elements.

12. A method of making a hollow structural element, particularly for use in multi-element construction kits, comprising the steps of injection molding a block-type housing having a circumferential wall which has two ends and two pairs of opposite side walls and bounds an interior space and which is formed with undercut portions at the inner surfaces of one pair of said opposite side walls, and an end wall which overlies and closes one of said ends of said circumferential wall, whereas another of said ends thereof remains open, and which said end wall is formed with an undercut groove extending over the entire length of said end wall from one up to another of one pair of said (end) opposite side walls and having open ends thereat so that a connecting member of a further element can be slidably received in said groove from either of said open ends thereof; injection molding a pair of partitions having side portions of undercut configuration complementary to said undercut portions of said circumferential wall, and a coupling projection portion projection from each of said partitions at said open end of said circumferential wall and being undercut complementarily to said undercut groove; and slidably inserting said side portions of said partitions into said undercut portions of said circumferential wall through said open end of the latter to form a structural element having said undercut groove at said closed end and said undercut projection portion at asid open end opposite to said closed end so that said undercut projection portions of said partitions can engage in undercut recesses of another structural element whereby the latter, in an engaged condition, bridges said open end of said first-mentioned structural element.

* * * * *